US010442581B2

(12) United States Patent
Gartz et al.

(10) Patent No.: US 10,442,581 B2
(45) Date of Patent: Oct. 15, 2019

(54) FOOD STORAGE CONTAINER CLOSURE

(71) Applicant: PACTIV LLC, Lake Forest, IL (US)

(72) Inventors: Mark R. Gartz, Mt. Prospect, IL (US); H. Bernard Kirkland, Lindenhurst, IL (US); Francisco Diaz, Bellflower, CA (US)

(73) Assignee: PACTIV LLC, Lake Forest, IL (US)

( * ) Notice: Subject to any disclaimer, the term of this patent is extended or adjusted under 35 U.S.C. 154(b) by 612 days.

(21) Appl. No.: 14/973,427

(22) Filed: Dec. 17, 2015

(65) Prior Publication Data

US 2016/0101910 A1 Apr. 14, 2016

Related U.S. Application Data

(63) Continuation of application No. 13/481,415, filed on May 25, 2012, now Pat. No. 9,242,769.

(51) Int. Cl.
*B65D 43/26* (2006.01)
*B65D 43/02* (2006.01)
*B65D 43/06* (2006.01)

(52) U.S. Cl.
CPC ..... *B65D 43/267* (2013.01); *B65D 43/0206* (2013.01); *B65D 43/06* (2013.01);
(Continued)

(58) Field of Classification Search
CPC ..... B65D 43/0206; B65D 2543/00833; B65D 2543/00694; B65D 2543/0062; B65D 2543/00462; B65D 2543/00944; B65D 2543/00916; B65D 2543/00888; B65D 85/36; B65D 43/0208; B65D 43/267; B65D 43/22; B65D 45/16; B65D 45/00; B65D 45/18; B65D 45/20; B65D 45/22
USPC ..... 220/783, 784, 793, 780, 4.21, 262, 799, 220/797, 796, 326, 324, 318, 315, 281, 220/574
See application file for complete search history.

(56) References Cited

U.S. PATENT DOCUMENTS 4,555,043 A * 11/1985 Bernhardt ..... B65D 43/0218 220/257.1
4,741,452 A * 5/1988 Holzkopf ..... B65D 43/0206 220/783

(Continued)

OTHER PUBLICATIONS

U.S. Appl. No. 13/481,415, filed May 25, 2012.

(Continued)

*Primary Examiner* — Allan D Stevens
(74) *Attorney, Agent, or Firm* — Baker Botts L.L.P.

(57) ABSTRACT

Container includes a base and a lid. The base has a base rim forming a base channel including a bottom wall, an inner sidewall, and an outer sidewall to define a channel space, a lock projection extending into the channel space from a first portion of the base rim, and a lever projection extending substantially outwardly from a second portion of the base rim. The lid has a lid rim forming a lid channel including a bottom wall, an inner sidewall, and an outer sidewall. The lid has a closed position in which the lid channel is aligned with and disposed at least partially within the channel space. The lever projection is configured to pivot upon application of an external force to cause the lock projection to move out from the channel space and to urge at least a portion of the lid rim out of the base channel.

23 Claims, 20 Drawing Sheets

(52) U.S. Cl.
CPC ..... *B65D 2543/0062* (2013.01); *B65D 2543/00092* (2013.01); *B65D 2543/00203* (2013.01); *B65D 2543/00296* (2013.01); *B65D 2543/00361* (2013.01); *B65D 2543/00462* (2013.01); *B65D 2543/00694* (2013.01); *B65D 2543/00759* (2013.01); *B65D 2543/00796* (2013.01); *B65D 2543/00833* (2013.01); *B65D 2543/00944* (2013.01)

(56) References Cited

U.S. PATENT DOCUMENTS 4,805,797 A * 2/1989 Natori ..... B65D 43/0212 220/315
5,018,624 A * 5/1991 Arneson ..... B65D 1/34 206/477
5,251,770 A * 10/1993 Bartley ..... B65D 43/0256 215/270
5,758,791 A 6/1998 Mangla
5,915,581 A * 6/1999 Pfirrmann, Jr. ..... B65D 1/36 220/4.21
8,056,751 B2 11/2011 Vovan et al.
D674,689 S 1/2013 Chen
2009/0020540 A1 1/2009 Vovan et al.

OTHER PUBLICATIONS

U.S. Appl. No. 13/481,415, filed Dec. 17, 2015 Issue Fee Payment
U.S. Appl. No. 13/481,415, filed Sep. 18, 2015 Notice of Allowance.
U.S. Appl. No. 13/481,415, filed Aug. 18, 2015 Response and Amendment after Final Office Action.
U.S. Appl. No. 13/481,415, filed May 13, 2015 Response after Final Office Action.
U.S. Appl. No. 13/481,415, filed Mar. 13, 2015 Final Office Action.
U.S. Appl. No. 13/481,415, filed Feb. 9, 2015 Response to Non-Final Office Action.
U.S. Appl. No. 13/481,415, filed Nov. 7, 2014 Non-Final Office Action.
U.S. Appl. No. 13/481,415, filed Jul. 9, 2014 Response to Restriciton Requirement.
U.S. Appl. No. 13/481,415, filed May 9, 2014 Restriction Requirement Filed.
"EZ Open Pete Cake Containers", brochure downloaded from http://www.inlineplastics.com/product_line/ez-open/ on Dec. 30, 2013.

* cited by examiner 200
246
204
246
244
202
244

202
204
216
214
212
218
228
226
224
222
236

FOOD STORAGE CONTAINER CLOSURE

CROSS-REFERENCE TO RELATED APPLICATIONS

This application is a continuation of U.S. patent application Ser. No. 13/481,415 filed May 25, 2012, which is incorporated by reference herein in its entirety.

BACKGROUND OF THE INVENTION

Field of the Invention

The present disclosed subject matter relates to a food packaging system of a disposable container for packaging and displaying food items, such as cakes. Particularly, the present disclosed subject matter is directed to a container for holding food items, wherein the container has a lid closure and release mechanism to provide improved opening and closing of the container lid.

Description of Related Art

Food items, such as baked goods, are often packaged in a container including a base and interlocking lid formed of thermoformed plastic sheeting. For purpose of example, a cake generally lies on a cardboard cake board that is, in turn, supported on a support surface of the base. In some cake containers, the consumer generally removes the lid by prying the lid away from the base, or otherwise grasping the lid on opposing sides and pulling up to disengage an interlocking closure mechanism. However, if the lid is not carefully moved upward, the lid can interact with the cake and damage the cake frosting or decorations.

As such, there remains a need for a food container having a release mechanism for removal of a lid from a base. Certain efforts have been made to develop such a mechanism. Some examples of conventional food containers, particularly cake containers, having lid closure and release mechanisms can be found in U.S. Pat. No. 8,056,751 and U.S. patent application Ser. No. 11/879,296, the disclosure of each of which is incorporated by reference herein in its entirety. However, there remains an opportunity for improvement for an efficient and economic method and system for a food storage container with a lid closure that securely encloses and stores the food product, yet provides a release mechanism for easy lid removal.

SUMMARY OF THE INVENTION

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages and in accordance with the purpose of the disclosed subject matter, as embodied and broadly described, the disclosed subject matter includes a container comprising a base and a lid. The base has a base rim forming a base channel including a bottom wall, an inner sidewall, and an outer sidewall to define a channel space, a lock projection extending into the channel space from a first portion of the base rim, and a lever projection extending substantially outwardly from a second portion of the base rim. The lid has a lid rim forming a lid channel including a bottom wall, an inner sidewall, and an outer sidewall. The lid has a closed position in which the lid channel is aligned with and disposed at least partially within the channel space of the base channel, and the lock projection is disposed to resist lifting of the lid channel out of the base channel. The lever projection is configured to pivot upon application of an external force to cause the lock projection to move out from the channel space and to urge at least a portion of the lid rim out of the base channel.

As embodied herein, the lock projection can be disposed above the lid channel outer sidewall in the closed position. The lid channel outer sidewall can define a notch to receive the lock projection in the closed position. The lock projection can be disposed on the base channel outer sidewall, and the base channel inner sidewall can have an inner lock projection disposed opposite the outer sidewall lock projection and extending into the channel space to further resist lifting of the lid channel out of the base channel in the closed position. The lid channel inner sidewall can have a notch to receive the inner lock projection, and the inner lock projection can be configured to move out from the channel space when the lever projection is pivoted. In some embodiments, the lock projection can be formed by an undercut in the base rim. The lock projection can be disposed beneath the at least a portion of the lid rim when in an open position to support the at least a portion of the lid rim.

The lever projection can be disposed at a corner of the base rim, and the lock projection can be disposed proximate the lever projection. The lock projection can include a pair of lock projection parts, and each of the pair of lock projection parts can be formed on an opposite side of the lever projection and proximate the lever projection. The lever projection can pivot about a hinge formed in the base channel. The hinge can include a pleat formed in the base channel proximate the lever projection, and the pleat can be configured to urge the at least a portion of the lid rim out of the base channel when the lever projection is pivoted. The hinge can also include a pair of pleats formed in the base channel, and each of the pair of pleats can be formed on an opposite side of the lever projection and proximate the lever projection.

In some embodiments, the lever projection can have a bottom surface to define a fulcrum about which the lever projection pivots, and the bottom surface can be arcuate. A top surface of the lever projection can define a recess proximate the base channel. A plurality of ribs can be disposed on the bottom surface of the base channel bottom wall, and the plurality of ribs can extend along the inner sidewall and outer sidewall of the base channel.

In some embodiments, the base can have a base bottom surface defining a base stacking feature, and the base stacking feature can be shaped to align with a lid stacking feature of a similarly shaped container. The lid and the base can be formed of sheet plastic.

According to another aspect of the disclosed subject matter, a container comprises a base and a lid. The base has a base rim forming a base channel including a bottom wall, an inner sidewall, and an outer sidewall to define a channel space, an inner lock projection and an outer lock projection each extending into the channel space from a first portion of the base rim on opposing sides of the base channel, and a lever projection extending substantially outwardly from a second portion of the base rim. The lid has a lid rim forming a lid channel including a bottom wall, an inner sidewall, and an outer sidewall. The lid has a closed position in which the lid channel is aligned with and disposed at least partially within the channel space of the base channel, and the inner lock projection and the outer lock projection each disposed to resist lifting of the lid channel out of the base channel. The lever projection is configured to pivot upon application of an external force to cause the outer lock projection to move out from the channel space to enlarge an opening of the base channel and to urge at least a portion of the lid rim out of the base channel.

In some embodiments, the inner lock projection can be configured to move out from the channel space when the lever projection is pivoted. The lid rim can have a lid flange extending outwardly from the lid channel, and the base outer lock projection can be disposed above the lid flange in the closed position.

It is to be understood that both the foregoing general description and the following detailed description are exemplary and are intended to provide further explanation of the disclosed subject matter claimed.

The accompanying drawings, which are incorporated in and constitute part of this specification, are included to illustrate and provide a further understanding of the method and system of the disclosed subject matter. Together with the description, the drawings serve to explain the principles of the disclosed subject matter.

DETAILED DESCRIPTION OF THE PREFERRED EMBODIMENT

Figure 1:
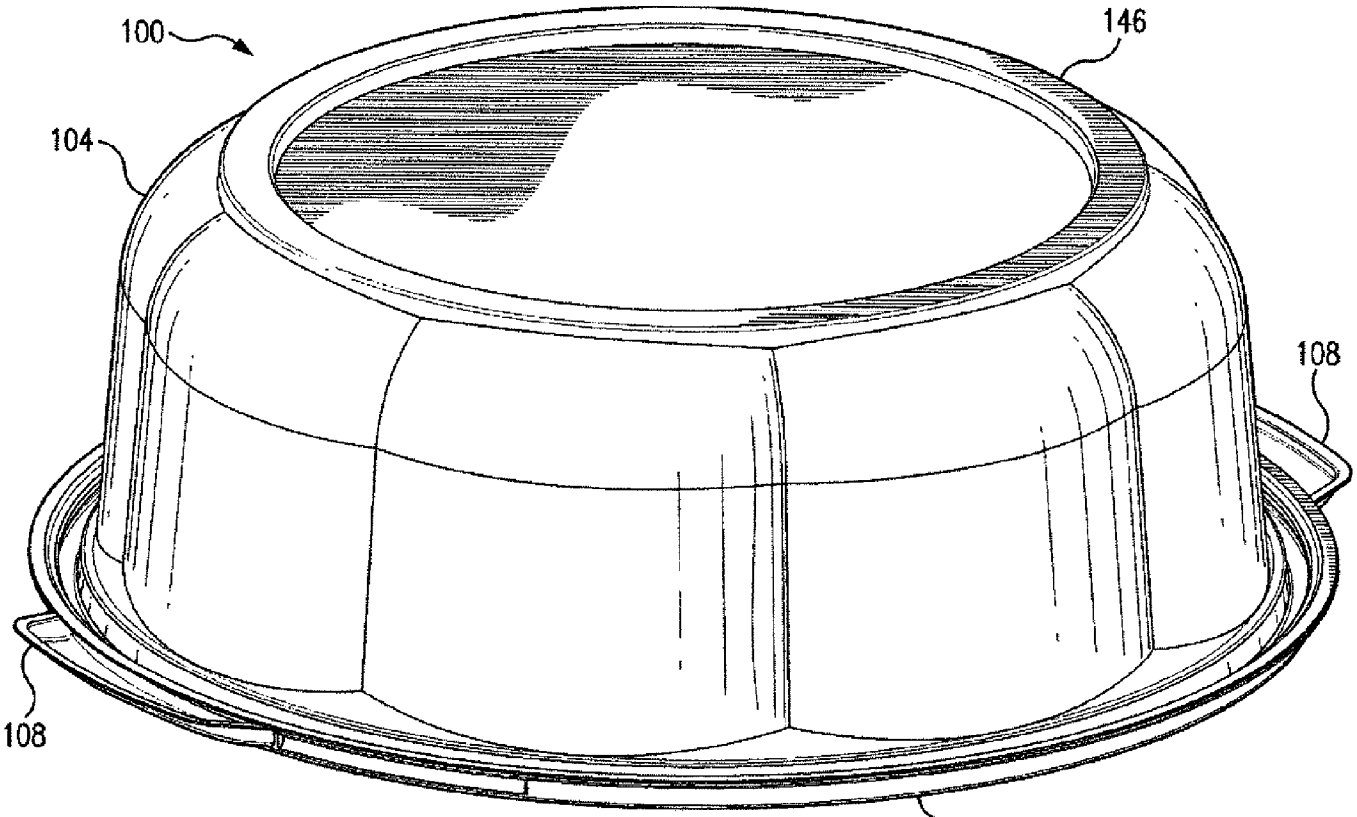
FIG. 1 is a perspective view of an exemplary embodiment of a container in accordance with the disclosed subject matter.

The apparatus and methods presented herein may be used for storage, transportation, and display of food items and other perishable and nonperishable products. The disclosed subject matter is particularly suited for storage, transportation, and display of food items, wherein the container lid and base provide a closure and release mechanism to allow easy closure and release of the lid without having to lift the container from a supporting surface, such as a table or countertop.

In accordance with the disclosed subject matter herein, the container includes a base and a lid. The base has a base rim forming a base channel including a bottom wall, an inner sidewall, and an outer sidewall to define a channel space, a lock projection extending into the channel space from a first portion of the base rim, and a lever projection extending substantially outwardly from a second portion of the base rim. The lid has a lid rim forming a lid channel including a bottom wall, an inner sidewall, and an outer sidewall. The lid has a closed position in which the lid channel is aligned with and disposed at least partially within the channel space of the base channel, and the lock projection is disposed to resist lifting of the lid channel out of the base channel. The lever projection is configured to pivot upon application of an external force to cause the lock projection to move out from the channel space and to urge at least a portion of the lid rim out of the base channel.

Reference will now be made in detail to the various exemplary embodiments of the disclosed subject matter, exemplary embodiments of which are illustrated in the accompanying drawings. The structure and corresponding method of operation of the disclosed subject matter will be described in conjunction with the detailed description of the system.

The accompanying figures, where like reference numerals refer to identical or functionally similar elements throughout the separate views, serve to further illustrate various embodiments and to explain various principles and advantages all in accordance with the disclosed subject matter. For purpose of explanation and illustration, and not limitation, exemplary embodiments of the container in accordance with the disclosed subject matter are shown in FIGS. 1-12C. The container is suitable for use with a wide variety of perishable and nonperishable products. However, for purpose of understanding, reference will be made to the use of the container disclosed herein with food items, wherein the container can be used for shipping, serving, storing, preparing and/or re-using such food items. Further, the container desirably, although not necessarily, can have suitable insulating properties to assist in maintaining the temperature and venting properties to control the moisture level within the container. For purpose of illustration, and not limitation, reference will made herein to a storage container intended to contain a cake or similar food item, wherein the container has a lid closure and release mechanism to provide improved opening and closing of the container lid.

Figure 2:
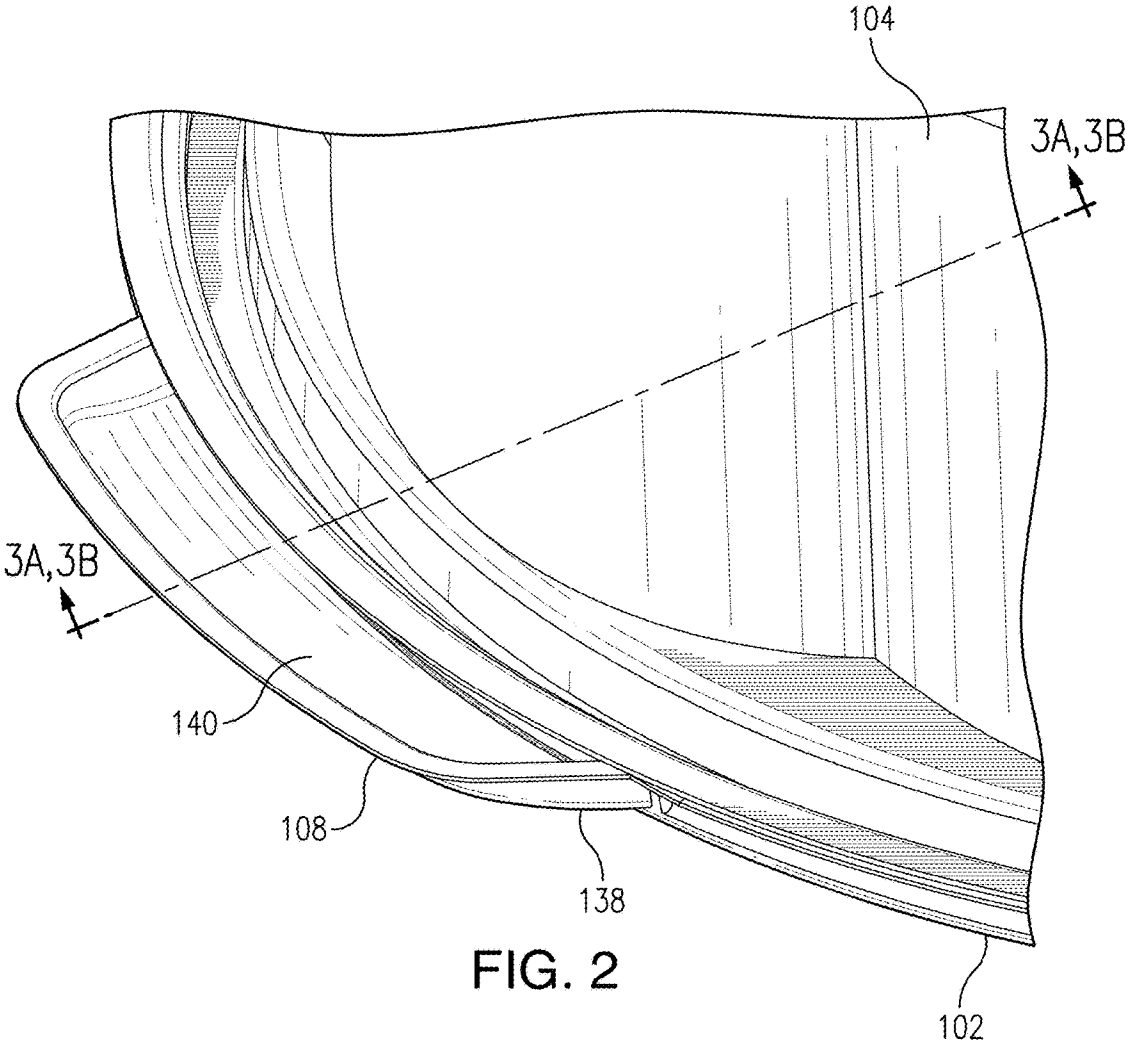
FIG. 2 is an enlarged perspective view of a portion of the container of FIG. 1.

In the exemplary embodiment shown in FIG. 1, the container 100 generally includes a base 102 and a lid 104. In this configuration, as illustrated, the container 100 can have a generally circular shape. Alternatively, the base 102 and lid 104 can form a container 100 with other geometric shapes. For example, the container 100 shape could be rectangular, square, triangular, or any geometrical shape. For purpose of illustration and not limitation, as shown in FIG. 2, the base 102 can have a support surface to support a product and a base rim 106 formed around at least a portion of its perimeter. A portion of the base rim 106 has a lever projection 108 extending radially outwardly from the base rim 106, as will be described in further detail below.

Figure 3A:
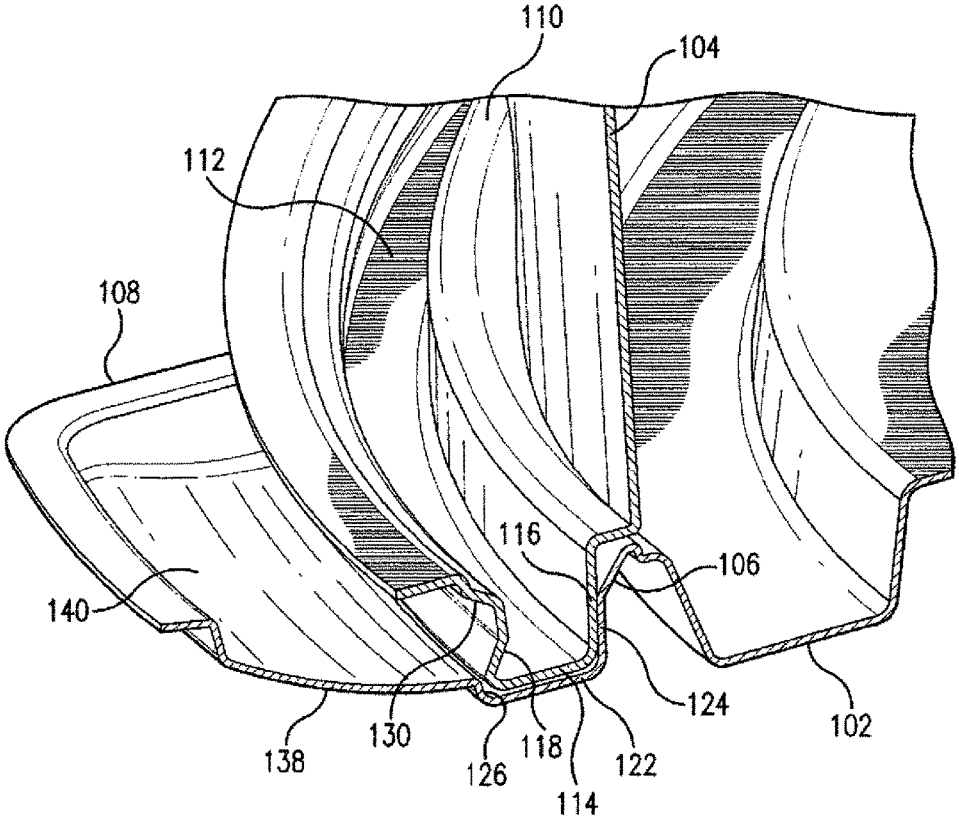
FIGS. 3A-3B are partial cross-sectional perspective views of the container of FIG. 1, with a portion cut away for illustration.
Figure 3B:
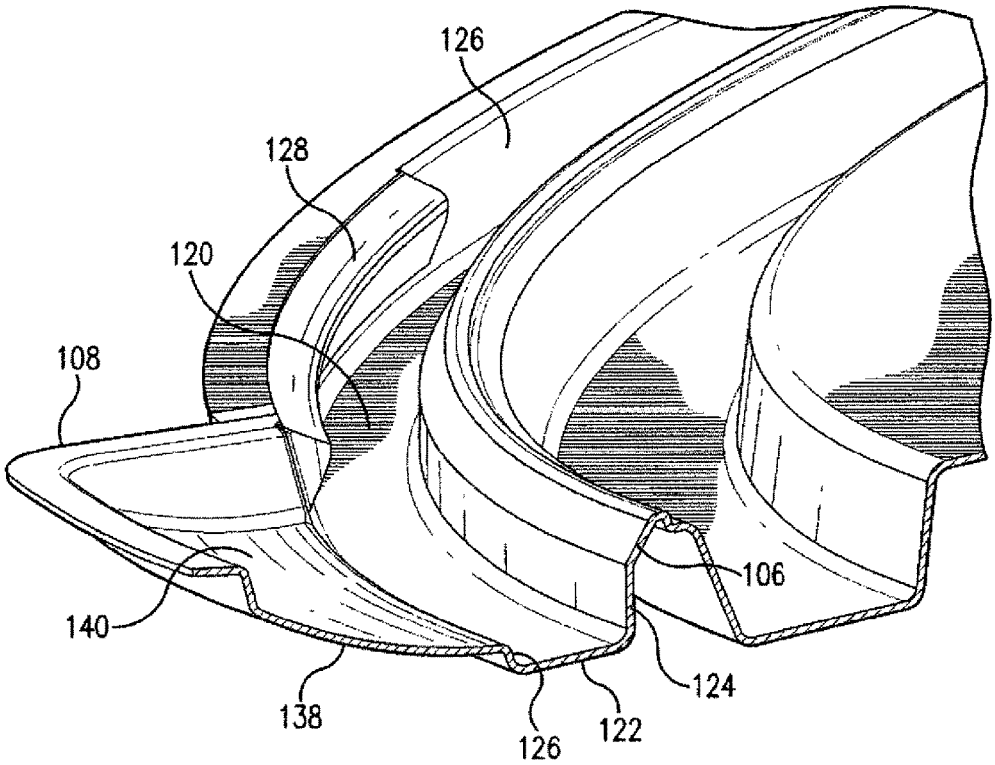

The lid 104 is shown in a closed position on the base, and the lid 104 has a lid rim 110 that engages the base rim 106 in the closed position. As best shown in FIGS. 3A-3B, the lid rim 110 forms a lid channel 112 having a bottom wall 114, inner sidewall 116, and outer sidewall 118. The base rim 106 forms a base channel 120 having a bottom wall 122, an inner sidewall 124, and an outer sidewall 126 to define a channel space. As embodied herein, the lid channel 112 in the closed position is disposed within the channel space of the base channel 120 in a snap-fit or other interlocking arrangement to secure the lid 104 to the base 102, as shown in FIG. 3A. For example, an interlocking arrangement for a lid and base is described in U.S. Pat. No. 8,056,751, the disclosure of which is incorporated by reference herein in its entirety. Additionally, as shown in FIG. 3B, a portion of the base rim 106 has a lock projection 128 extending from the outer sidewall 126 into the channel space of the base channel 120. The lock projection 128 can be disposed on a portion of the base rim 106 proximate each lever projection 108. The lock projection 128 can likewise be disposed on an opposite side of the lever projection 108. As further described below, the lock projection 128 can resist lifting of the lid channel 112 out of the channel space of the base channel 120 to further secure the lid 104 to the base 102 in the closed position.

Figure 4:
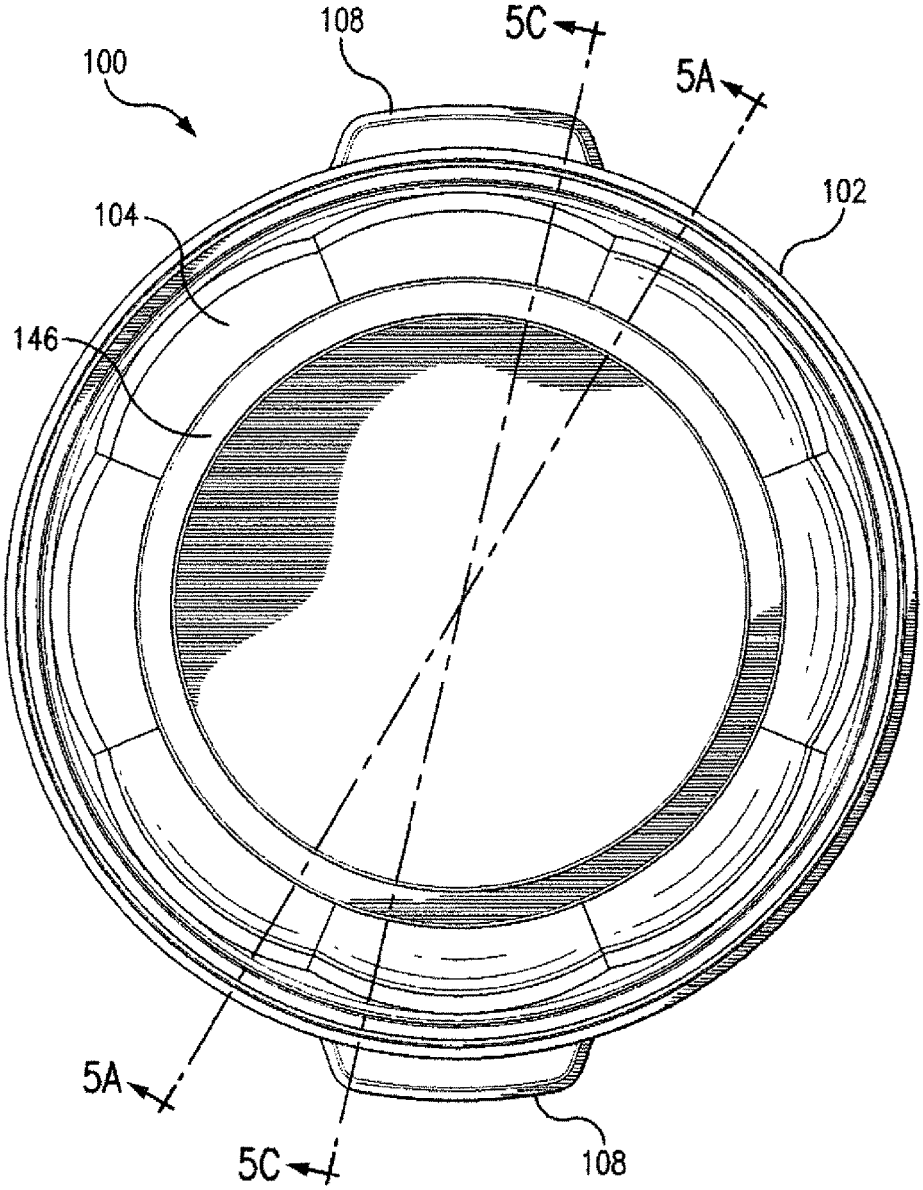
FIG. 4 is a top view of the container of FIG. 1.

FIG. 4 shows a top view of the exemplary container 100. The base 102 can have a single lever projection 108, or a plurality of lever projections 108 spaced about the base rim 106. For example, as shown in FIG. 4, the base 102 embodied herein has two lever projections 108 on diametrically-opposed sides of the container 100. However, it is contemplated that a base 102 according to the disclosed subject matter can have any suitable number of lever projections 108.

Figure 5A:
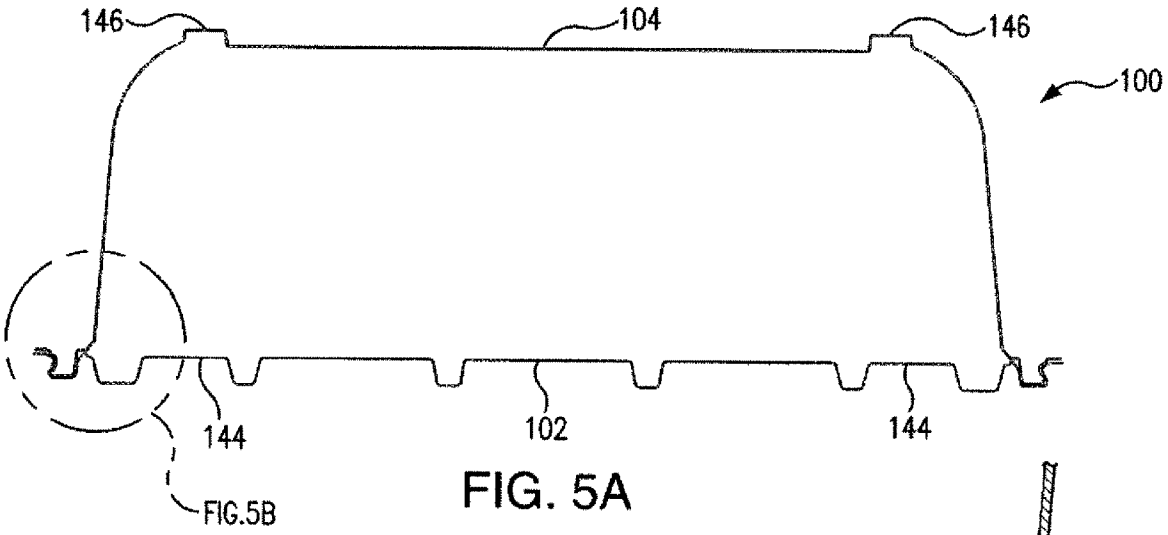
FIG. 5A is a cross-section of the container of FIG. 1, taken along line 5A-5A in FIG. 4.

To further illustrate the closure and release mechanism, cross-sections are taken along lines 5A-5A and 5C-5C in FIG. 4. The cross-section along line 5A-5A is shown in FIG. 5A, which intersects a portion of the base rim 106 having lock projections 128. The cross-section along line 5C-5C is shown in FIG. 5C, which intersects a portion of the base rim 106 having lever projections 108.

Figure 5B:
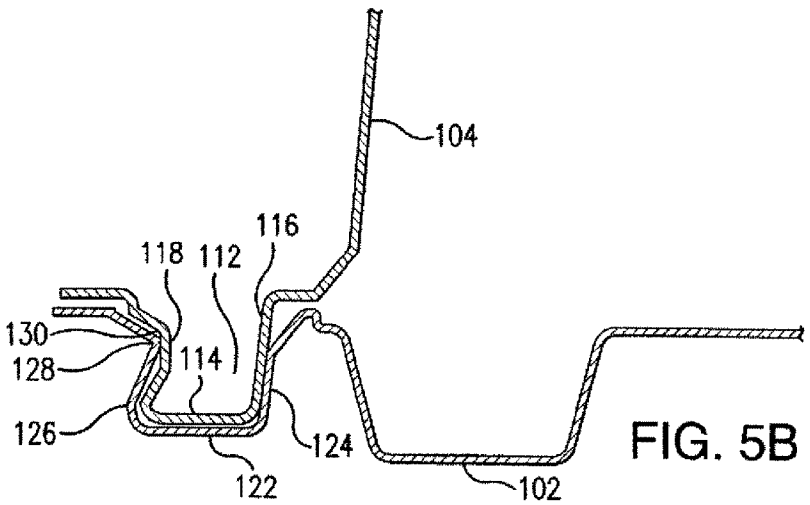
FIG. 5B is an enlarged cross-sectional view of a portion of the cross-section of FIG. 5A along detail line 5B.

FIG. 5B shows an enlarged view of the base rim 106 and lid rim 110 portion indicated in FIG. 5A. As shown, the lock projection 128 of the base rim 106 extends radially-inwardly from the outer wall 126 of the base channel 120 and engages the lid rim 110. The lock projection 128 can be formed, for example, by an undercut in the base rim 106. The lid rim 110 can have a notch 130 formed, for example by an undercut in the lid rim 110, in the outer sidewall 118 of the lid channel 112 and sized to receive the lock projection 128 in the closed position. Thus, the lock projection 128 resists lifting up of the lid channel 112 from the channel space of the base channel 120 to secure the lid 104 to the base 102.

Figure 5C:
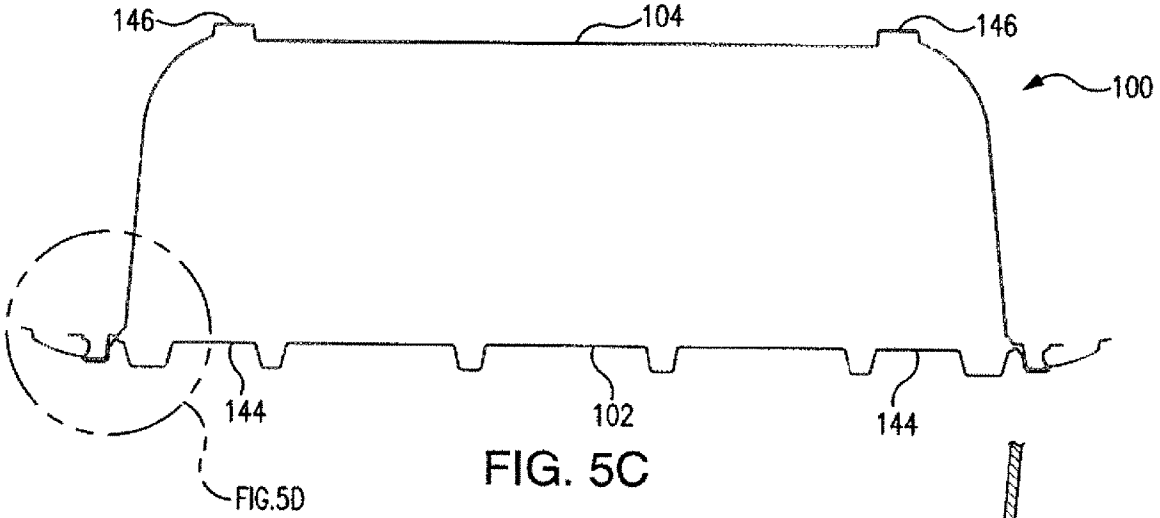
FIG. 5C is a cross-section of the container of FIG. 1, taken along line 5C-5C in FIG. 4.
Figure 5D:
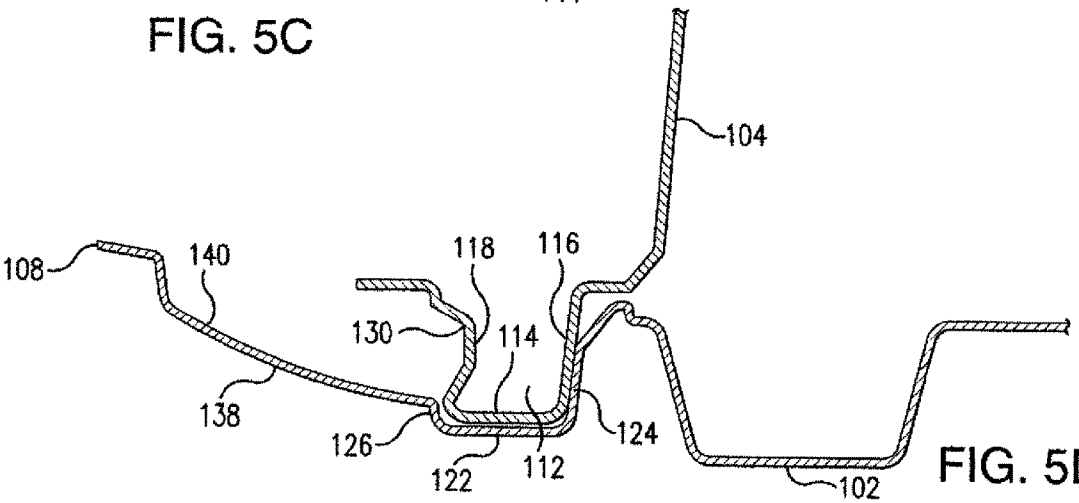
FIG. 5D is an enlarged cross-sectional view of a portion of the cross-section of FIG. 5C along detail line 5D.

FIG. 5D shows an enlarged view of the base rim 106 and lid rim 110 portion indicated in FIG. 5C. As shown, the lever projection 108 extends radially outwardly from the base channel 120. The lever projection 108 embodied herein has a top surface with a recess 140 formed therein, which can provide a space into which a user can press to apply a force to the lever projection 108. See also, FIGS. 3A-3B. The lever projection 108 has a bottom surface, which can be arcuate or other suitable shape to define a fulcrum 138 about which the lever projection 108 can pivot. The bottom surface of fulcrum 138 can allow the lever projection 108 to pivot when pressed down upon a flat surface supporting the container 100. The actual position of the fulcrum 138 can be at any suitable point based on the geometry, materials and stiffness of the materials such that functionally applying a force to the lever projection 108 urges disengagement of the lid 104 and base 102 as described in more detail herein.

Figure 6A:
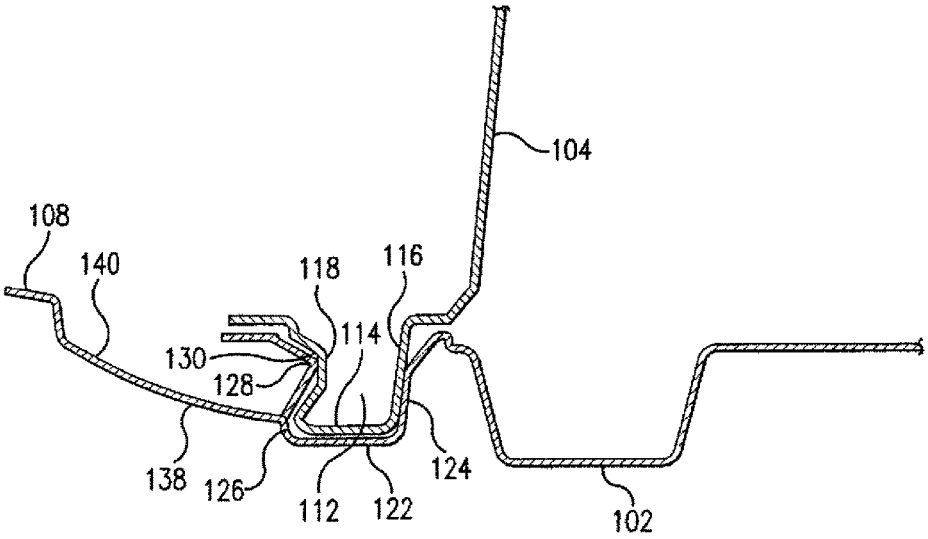
FIGS. 6A-6C are schematic cross-sectional views illustrating an exemplary closure/release mechanism according to the disclosed subject matter.
Figure 6B:
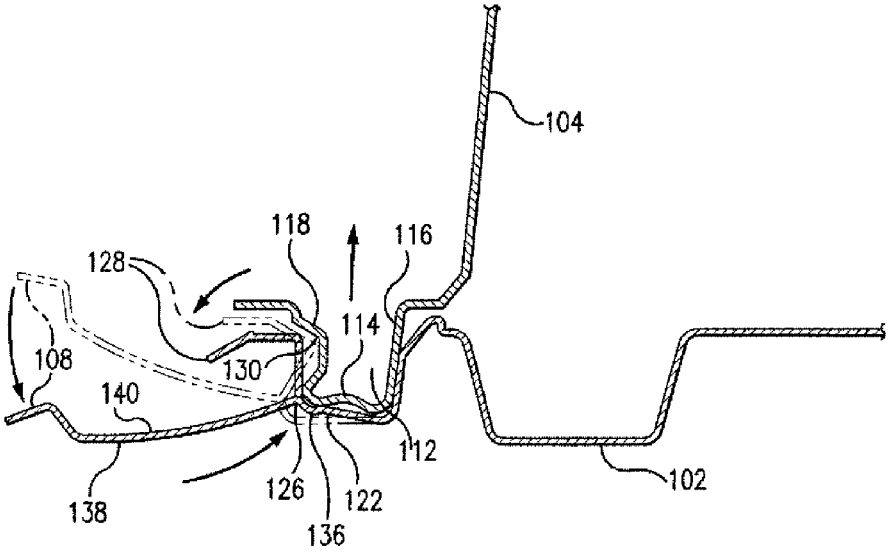
Figure 6C:
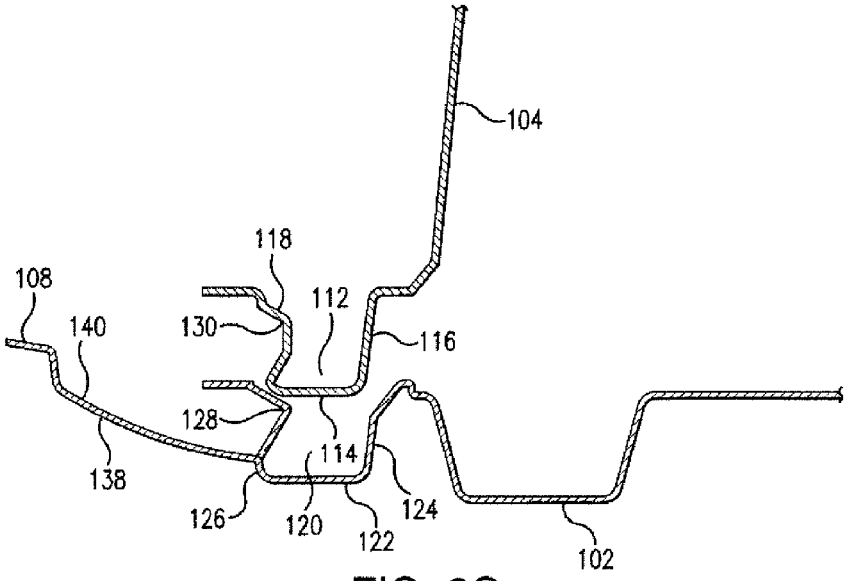

FIGS. 6A-6C schematically and sequentially illustrate the operation of an exemplary closure and release mechanism according to the disclosed subject matter. To illustrate the cooperation of the lever projection 108 portions of the base rim 106 with the lock projection 128 portions of the base rim 106, FIGS. 6A-6C each shows a cross-section of the lock projection 128 portion (for example, as in FIG. 5B) overlaid onto a cross-section of the lever projection 108 portion (for example, as in FIG. 5D).

FIG. 6A shows the lid 104 initially in a closed position, with the lid channel 112 disposed within the channel space of the base channel 120, the lock projection 128 engaging the recess 130 of the lid rim 110, and the lever projection 108 extending radially outwardly from the base rim 106, as described herein above.

FIG. 6B shows the configuration of FIG. 6A with a downward force applied to the lever projection 108. The original position of the base rim 110 of FIG. 6A is shown in phantom. The downward force applied to the lever projection 108 pivots the lever projection 108 about a pivot axis disposed generally within the base channel 120. The pivot axis can be an area of deflection of the outer wall 126 and/or bottom wall 122 of the base channel 120. Additionally or alternatively, a pleat 136 or similar formation can be provided in the base channel 120 to define the pivot axis or hinge for the lever projection 108, as described in more detail with reference to the embodiment of FIGS. 7-12C. The pivotal movement of the lever projection 108 causes the lock projection 128 to rotate radially outward and away from engagement with the lid rim 110. Additionally, the pivotal movement causes a portion of the outer sidewall 126 and a portion of the bottom wall 122 of the base channel 120 proximate the pivot axis to compress inward and rotate upward. The compression of the base channel 120 and the upward movement of the base channel 120 urges the lid channel 112 upward. The lid channel 112, which is no longer engaged with the lock projection 128, is thus moved upward and out of the channel space of the base channel 120. As embodied herein, the lid will "pop" out of the base for ease of removal as described below.

FIG. 6C shows the lid 104 in an open position, disengaged from the base 102. Once in the open position, the external force can be removed from the lever projection 108, allowing the lever projection 108 to rotate back to its original position. In this manner, the lock projection 128 rotates inwardly to its original position. With the lid 104 disposed in the open position, the lock projection 128 moves underneath the bottom wall 114 of the lid channel 112 to support the lid 104 in the open position.

With the lid 104 in the open position, a user can then remove the lid 104 entirely from the base 102 by lifting the lid 104 straight up relative to the base 102 until the lid 104 is moved up beyond the height of a product resting on the base 102. For example, if the product is a tall cake, the lid 104 can be moved up beyond the height of the cake without the sides or bottom of the lid 104 disturbing a frosted or decorated surface of the cake. If the base 102 has a plurality of lock projections 128 engaging the lid rim 110 and a corresponding plurality of lever projections 108 to release the lock projections 128, each of the lever projections 108 can be operated independently and/or simultaneously as described above to disengage each of the lock projections 128, and thus disengage the lid 104 from the base 102. For example, by configuring the lever projections 108 to be operated independently, a user can disengage the lid 104 from the base 102 using only one hand.

To restore the lid 104 to the closed position, with the lid 104 in the open position shown in FIG. 6C, a user can apply a downward force to the lid 104. The downward force applied to the lid 104 can urge the lid channel 112 down beyond the lock projection 128 and into the channel space of the base channel 120, and thus engage the lock projection 128 with the lid channel 112. The base rim 106 can be provided with an angled or beveled surface proximate an upper edge of the base channel 120 to resist urging the lid rim 110 into the channel space of the base channel 120 in this reclosing step.

Additionally, as shown for example in FIG. 5A, the container 100 can include features to allow for stacking of a container 100 of a similar configuration. For example, the base can have a base bottom surface defining a base stacking feature 144. The base stacking feature 144 can be shaped to align with and receive a lid stacking feature 146 formed in the lid 104 of a similarly shaped container.

The base and lid described herein can be manufactured from any suitable material, for example, expanded polystyrene foam, oriented polystyrene (OPS), polypropylene, mineral filled polypropylene, amorphous polyethylene terephthalate (APET), thermoplastics, and paper. It is to be understood that the foregoing list is not exhaustive, and that the containers can be made from other suitable materials. In one exemplary embodiment, a base 102 and lid 104 having the features described herein is each formed respectively from a single sheet of polymeric material. The material of the base 102 can be the same as the material of the lid 104, or each can be formed of a different material. For example, the base 102 can be formed of an opaque polymeric material, while the lid 104 can be formed of a transparent polymeric material. Forming a base 102 can include providing a sheet of polymeric material, or other suitable material, and forming the material into a base 102 having various features described herein. Forming a lid 104 can include providing a sheet of polymeric material, or other suitable material, and forming the material into a base 104 having various features described herein. The base 102 and lid 104 can be formed utilizing any conventional type of thermoforming, stamping, or molding process, or other suitable process.

The base and lid disclosed herein can be made of a durable construction for multiple use and washing between uses, or can be made for disposable, single use. Also, the base and lid can be constructed from materials suitable to be placed in a heating apparatus, such as a microwave, to heat the food and/or used for storage in the refrigerator or freezer.

It is to be recognized that the dimensions and relative proportions of the container will vary according to the size and intended use of the container and related contents. While a generally circular container 100 is illustrated in FIG. 1, one of ordinary skill will recognize that any suitable shape and size of container 100 can be employed and the disclosed subject matter is not so limited. Other suitable shapes include rectangles, ovals, various polygons, etc.

Figure 7:
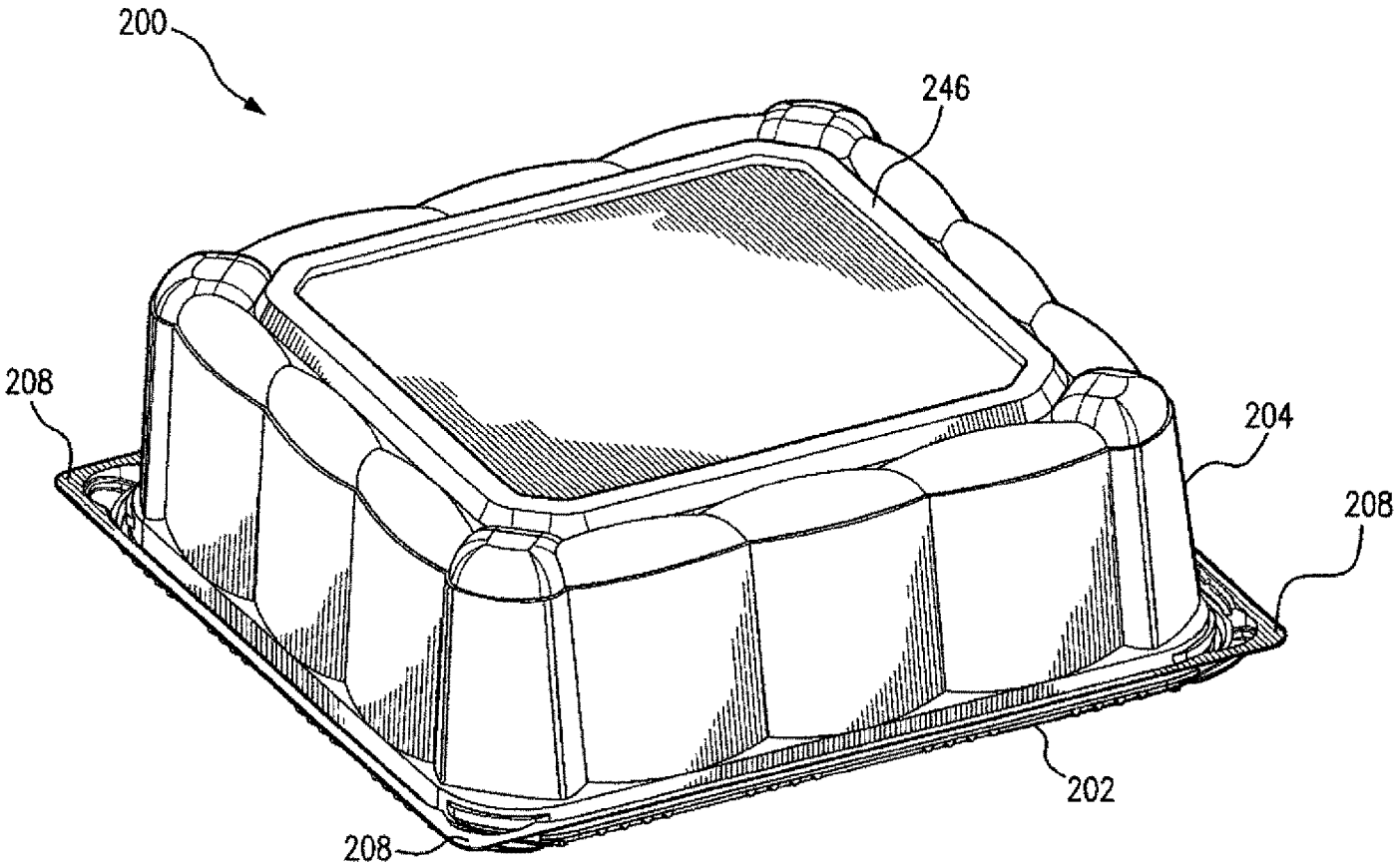
FIG. 7 is a perspective view of another exemplary embodiment of a container in accordance with the disclosed subject matter.
Figure 8:
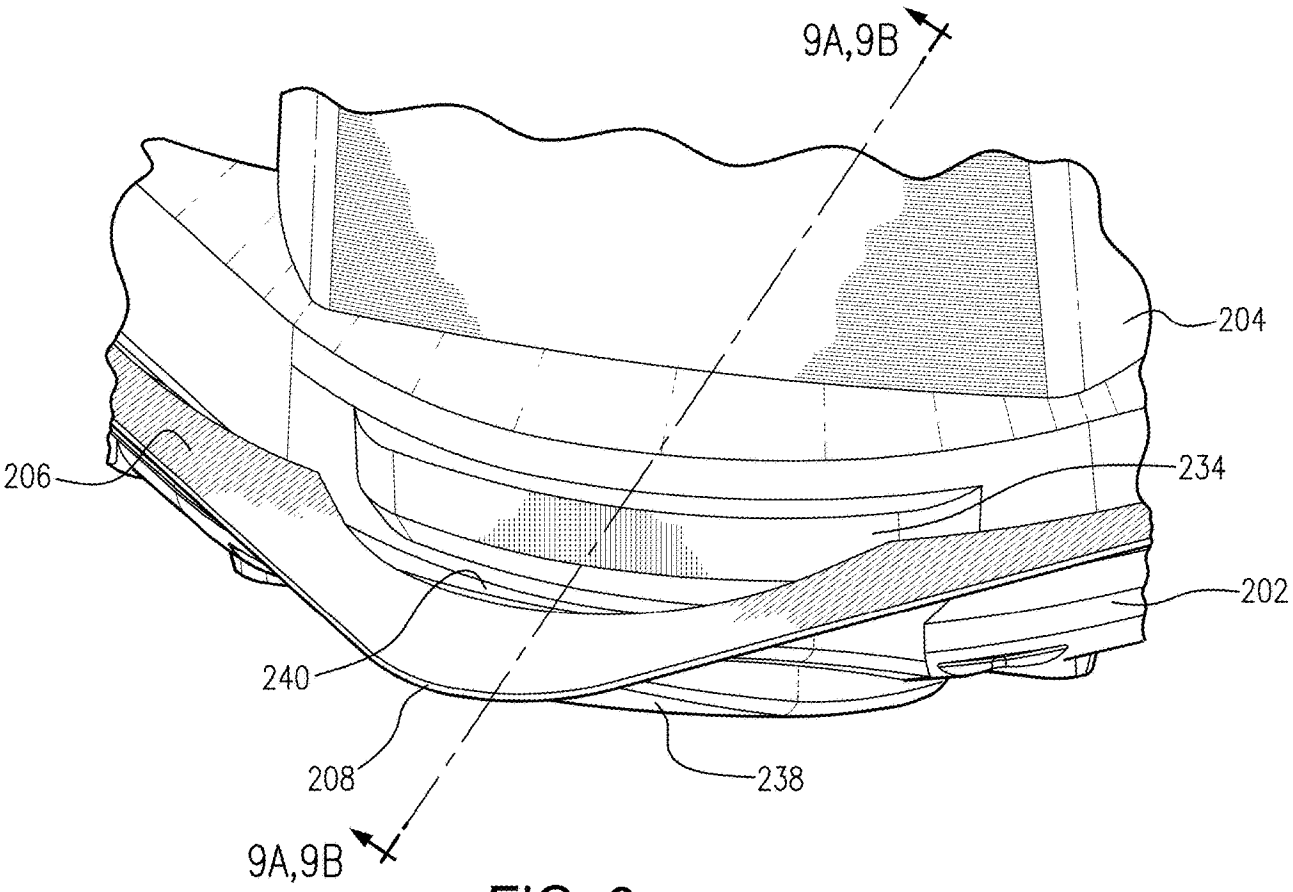
FIG. 8 is an enlarged perspective view of a portion of the container of FIG. 7.

For example, FIG. 7 shows another exemplary embodiment of a container 200 having a rectangular shape an alternative exemplary closure and release mechanism. For purpose of illustration and not limitation, as best shown in FIG. 8, the base 202 can have a support surface to support a product and a base rim 206 formed around at least a portion of its perimeter. A portion of the base rim 206 has a lever projection 208 extending radially outwardly from the base rim 206. In this configuration, for purpose of illustration and not limitation, the lever projection 208 is disposed at a corner of the base rim 206.

Figure 9A:
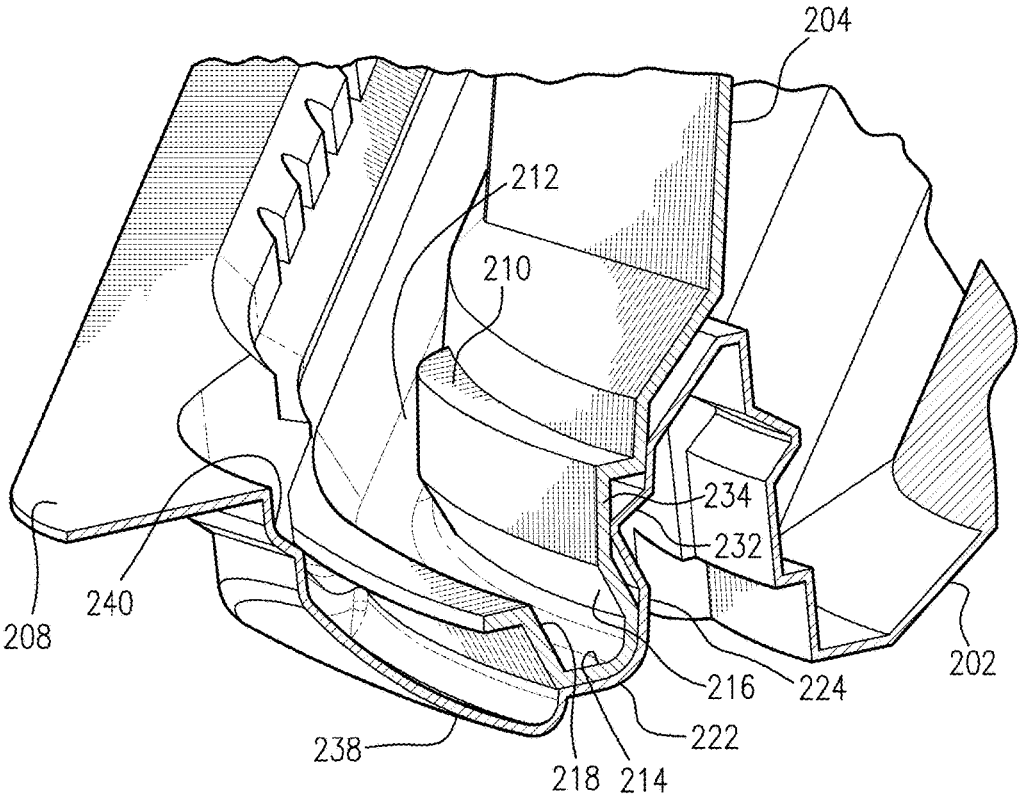
FIGS. 9A-9B are partial cross-sectional perspective views of the container of FIG. 7, with a portion cut away for illustration.
Figure 9B:
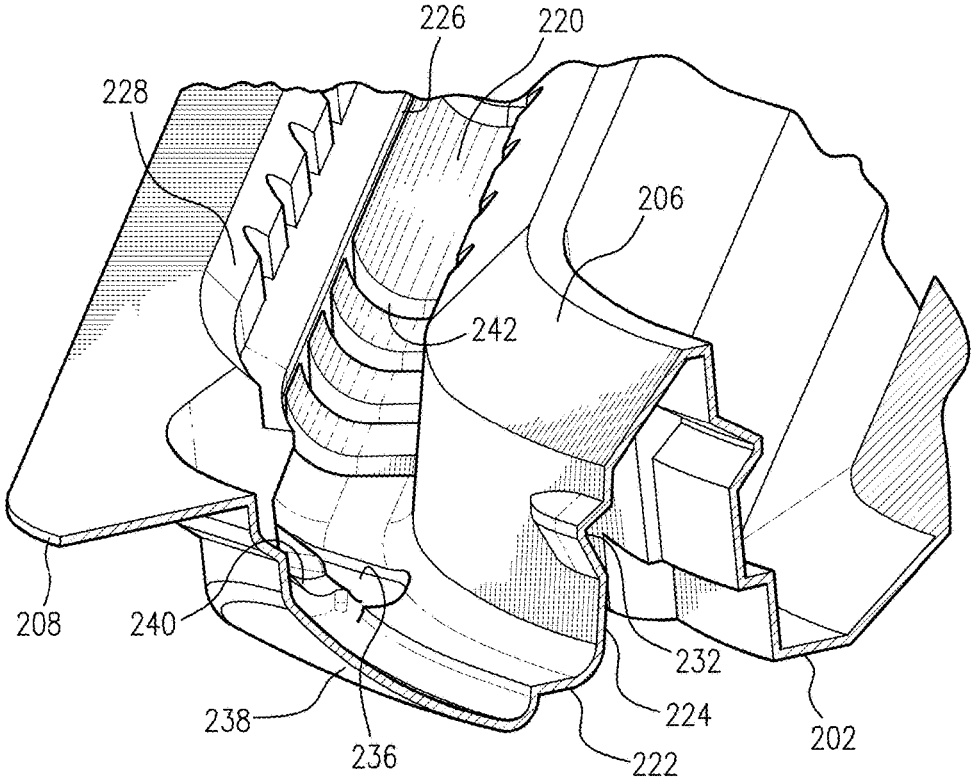

The lid 204 is shown in a closed position on the base, and the lid 204 has a lid rim 210 that engages the base rim 206 in the closed position. As best shown in FIGS. 9A-9B, the lid rim 210 forms a lid channel 212 having a bottom wall 214, inner sidewall 216, and outer sidewall 218. The base rim 206 forms a base channel 220 having a bottom wall 222, an inner sidewall 224, and an outer sidewall 226 to define a channel space. In the closed position, the lid channel 212 is disposed within the channel space of the base channel 220 in a snap-fit or other interlocking arrangement, securing the lid 204 to the base 202. Additionally, as shown in FIG. 9B, a portion of the base rim 206 has a lock projection 228 extending from the outer sidewall 226 into the channel space of the base channel 220. The lock projection 228 can also be disposed on an opposite side of the lever projection 208. As embodied herein, and in accordance with an additional aspect of the disclosed subject matter, an inner lock projection 232 extends from the inner sidewall 224 of the base channel 220 into the channel space. A notch 234, which can be formed by an undercut or the like in the inner sidewall 216 of the lid channel 212, can be disposed thereon to receive the inner lock projection 232 in the closed position. As shown herein, the inner lock projection 232 can be aligned with the lever projection 208 on the base rim 206. Alternatively, the inner lock projection 232 can be aligned with the lock projection 228 on the base rim 206. As further described below, the lock projection 228 and inner lock projection 232 can resist lifting of the lid channel 212 out of the channel space of the base channel 220 to further secure the lid 204 to the base 202 in the closed position.

Additionally, as shown in FIG. 9B, and in accordance with another aspect of the disclosed subject matter, a portion of the base channel 220 can have a pleat 236 defined therein. As previously described with reference to the embodiment of FIGS. 1-6C, the pleat 236 defines a pivot axis about which the lever projection 208 can pivot. An additional pleat 236 can be formed on an opposite side of the lever projection 208. As depicted herein, the pleat 236 is defined as a score line or the like in the bottom wall 222 of the base channel 220. Additionally or alternatively, the pleat 236 can include a score line or the like in the outer sidewall 226 and/or the inner sidewall 224 of the base channel 220. The pleat 236 herein is configured to fold upon application of a force to the lever projection 208. For example, and as depicted in FIG. 9B, a first score line of the pleat 236 extends diagonally along the bottom wall 222 of the base channel 220 from the inner sidewall 224 opposite the lever projection 208 to the outer sidewall 226 proximate the lock projection 228. Another score line of the pleat 236 can extend diagonally along the bottom wall 222 of the base channel 220 from the inner sidewall 224 opposite the lever projection 208 to the recess 240 of the lever projection. In this manner, the score lines of the pleat 236 together can substantially form a "V" shape or "✓" shape in the base channel 220. Additionally, the folding of the pleat 236 formed in the base channel 220 can further urge the lid channel 212 upward and out of the channel space of the base channel 220 when the force is applied to the lever projection 208.

Figure 10:
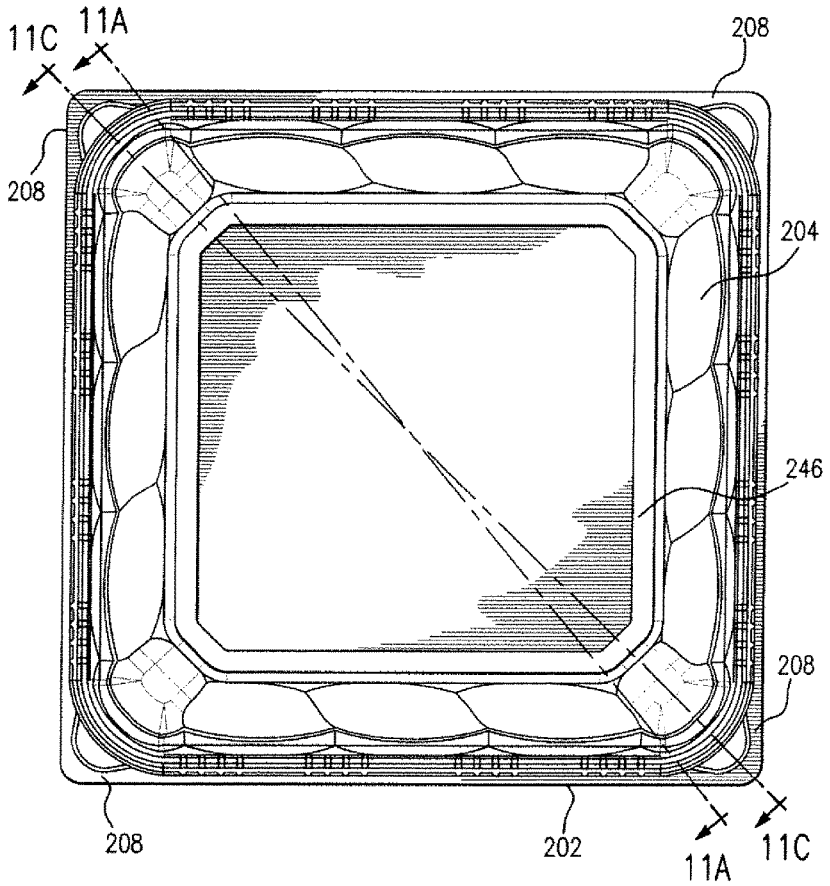
FIG. 10 is a top view of the container of FIG. 7.

FIG. 10 shows a top view of the exemplary container 200. In this configuration, the base 202 can have can have four lever projections 208, with each lever projection 208 disposed at a corner of the container 200. However, it is contemplated that a base 202 according to the disclosed subject matter can have any suitable number of lever projections 208. Additionally, as shown for example in FIG. 10, the base can have ribs 242 formed in the base channel 220 for additional strength. Ribs 242 can extend along the inner sidewall 224 and outer sidewall 226 of the base channel 220.

Figures 11A, 11B:
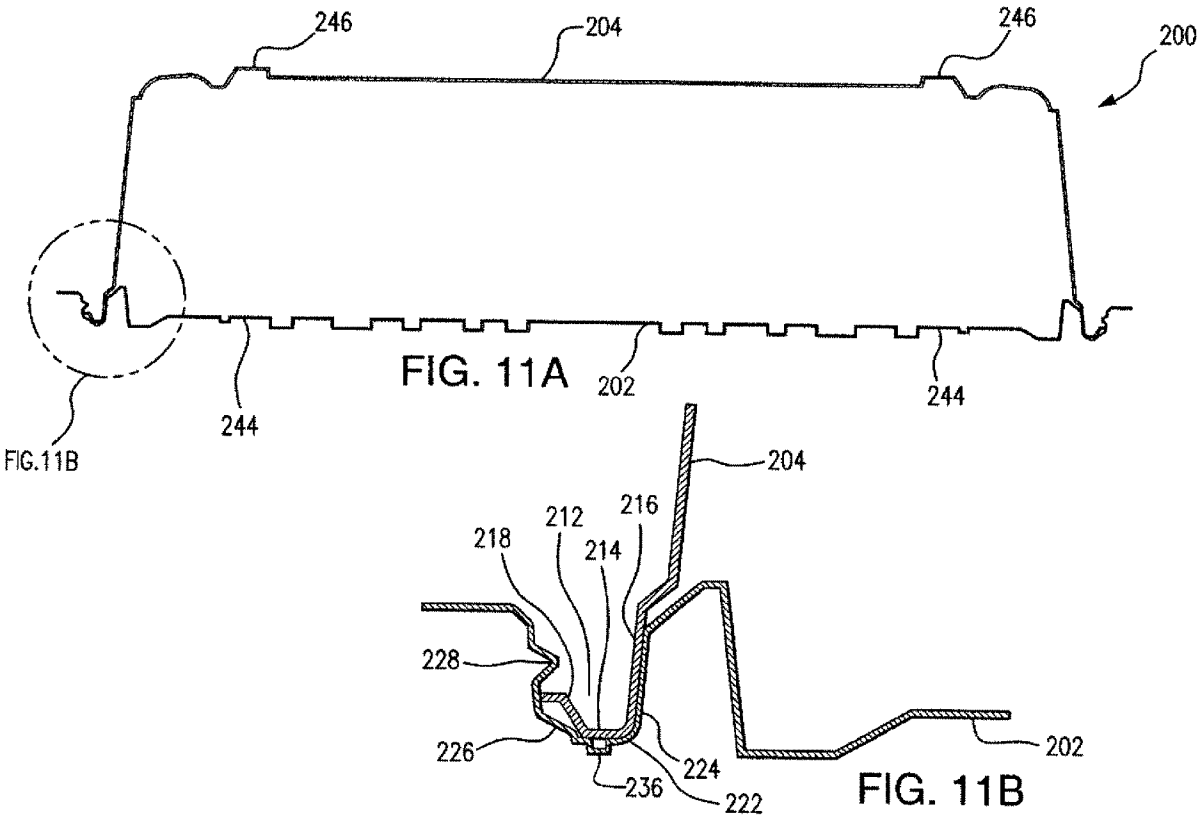
FIG. 11A is a cross-section of the container of FIG. 7, taken along line 11A-11A in FIG. 10.
FIG. 11B is an enlarged cross-sectional view of a portion of the cross-section of FIG. 11A along detail line 11B.

To further illustrate the closure and release mechanism, cross-sections are taken along lines 11A-11A and 11C-11C in FIG. 10. The cross-section along line 11A-11A is shown in FIG. 11A, which intersects a portion of the base rim 206 having lock projections 228. The cross-section along line 11C-11C is shown in FIG. 11C, which intersects a portion of the base rim 206 having lever projections 208 and inner lock projections 232.

FIG. 11B shows an enlarged view of the base rim 206 and lid rim 210 portion indicated in FIG. 11A. As shown, the lock projection 228, which can be formed by an undercut in the base rim 206, extends from the outer sidewall 226 of the base channel 220 into the channel space and is disposed proximate the top of the outer sidewall 218 of the lid channel 212. Thus, the lock projection 228 resists lifting up of the lid channel 212 from the channel space of the base channel 220 to secure the lid 204 to the base 202.

Figure 11C:
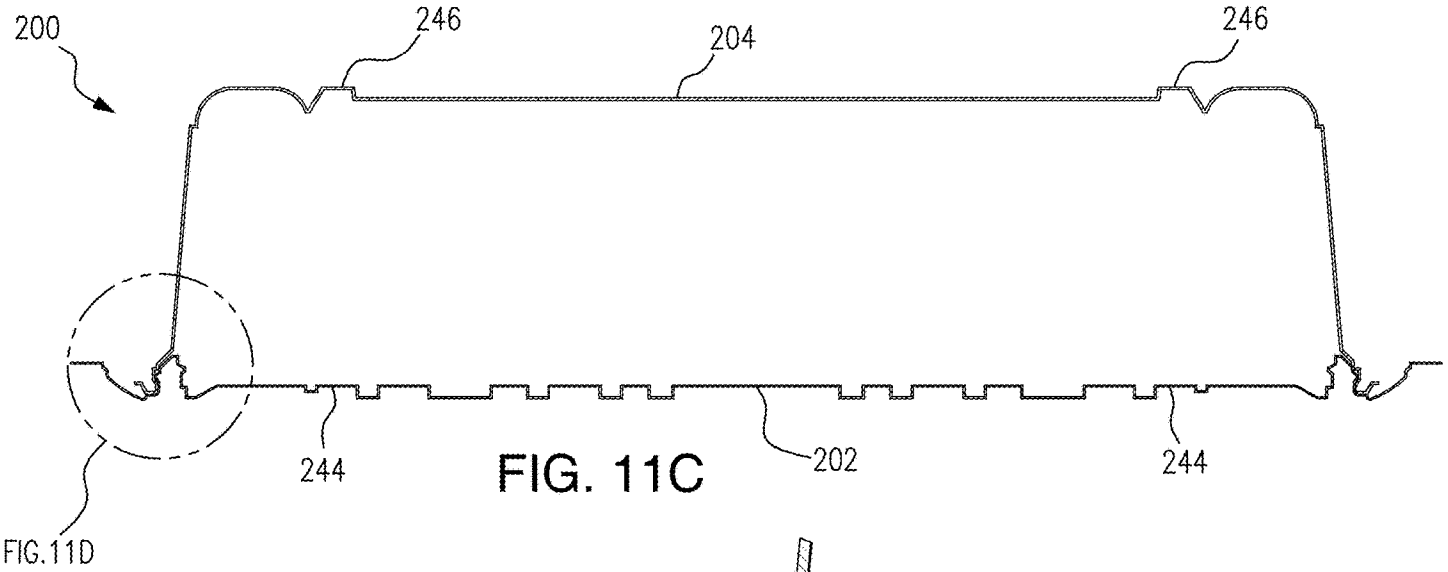
FIG. 11C is a cross-section of the container of FIG. 7, taken along line 11C-11C in FIG. 10.
Figure 11D:
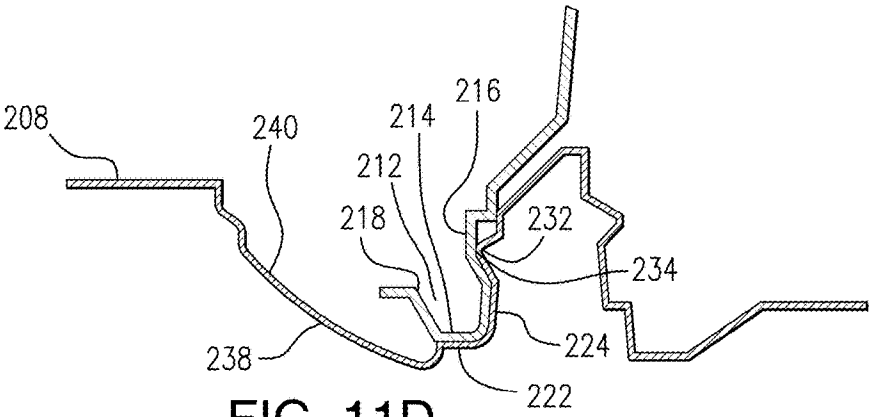
FIG. 11D is an enlarged cross-sectional view of a portion of the cross-section of FIG. 11C along detail line 11D.

FIG. 11D shows an enlarged view of the base rim 206 and lid rim 210 portion indicated in FIG. 11C. As shown, the inner lock projection 232, which can be formed by an undercut in the base rim 206, extends into the channel space of the base channel 220 and engages the notch 234 in the inner sidewall 216 of the lid channel 212, and thus further resists lifting up of the lid channel 212 from the channel space of the base channel 220. As shown, the lever projection 208 extends radially outwardly from the base channel 220. The lever projection 208 embodied herein has a top surface with a recess 240 formed therein, which can provide a space into which a user can press to apply a force to the lever projection 208. See also, FIGS. 9A-9B. The lever projection 208 has a bottom surface, which can be arcuate or other suitable shape to define a fulcrum 238 about which the lever projection 208 can pivot. The bottom surface of fulcrum 238 can allow the lever projection 208 to pivot when pressed down upon a flat surface supporting the container 200. The depiction of the fulcrum in 238 in FIG. 11D is illustrative only. The actual position of the fulcrum 238 can be at any suitable point based on the geometry, materials and stiffness of the materials such that functionally applying a force to the lever projection 208 urges disengagement of the lid 204 and base 202 as described in more detail herein.

Figure 12A:
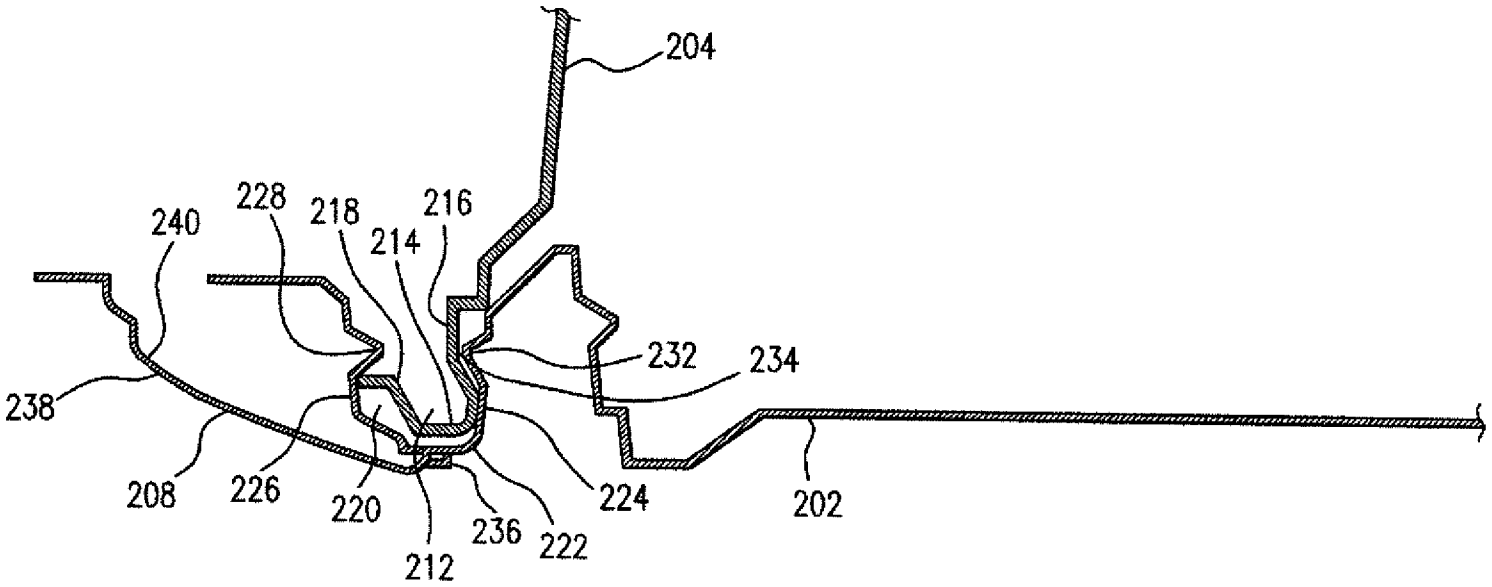
FIGS. 12A-12C are schematic cross-sectional views illustrating another exemplary closure/release mechanism according to the disclosed subject matter.
Figure 12B:
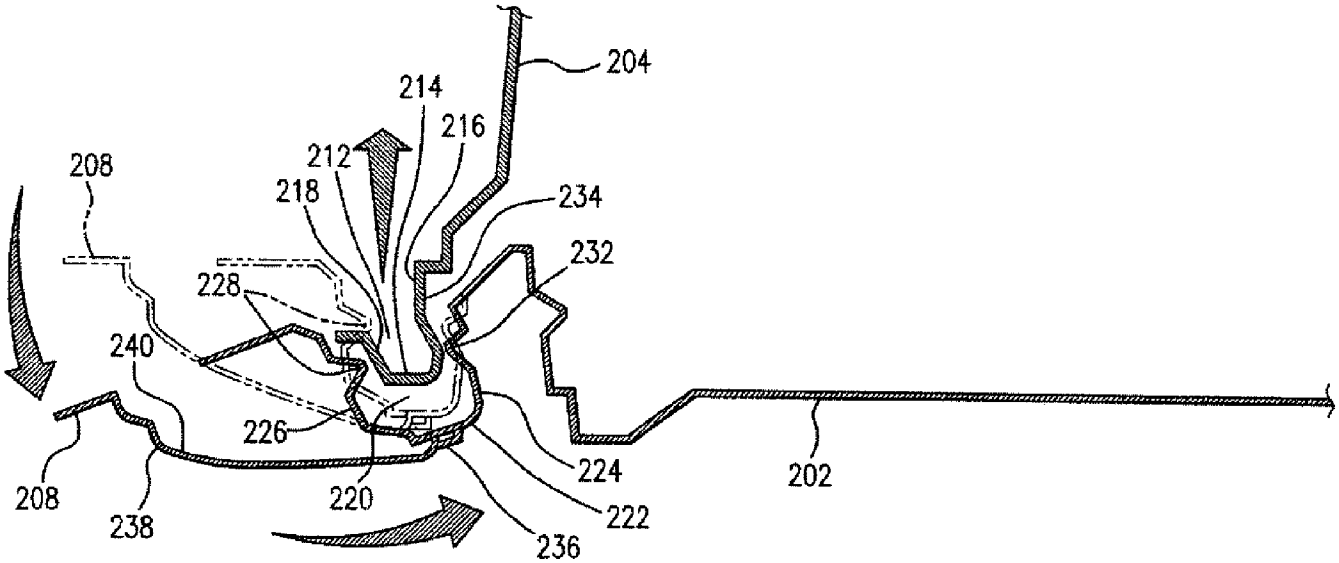
Figure 12C:
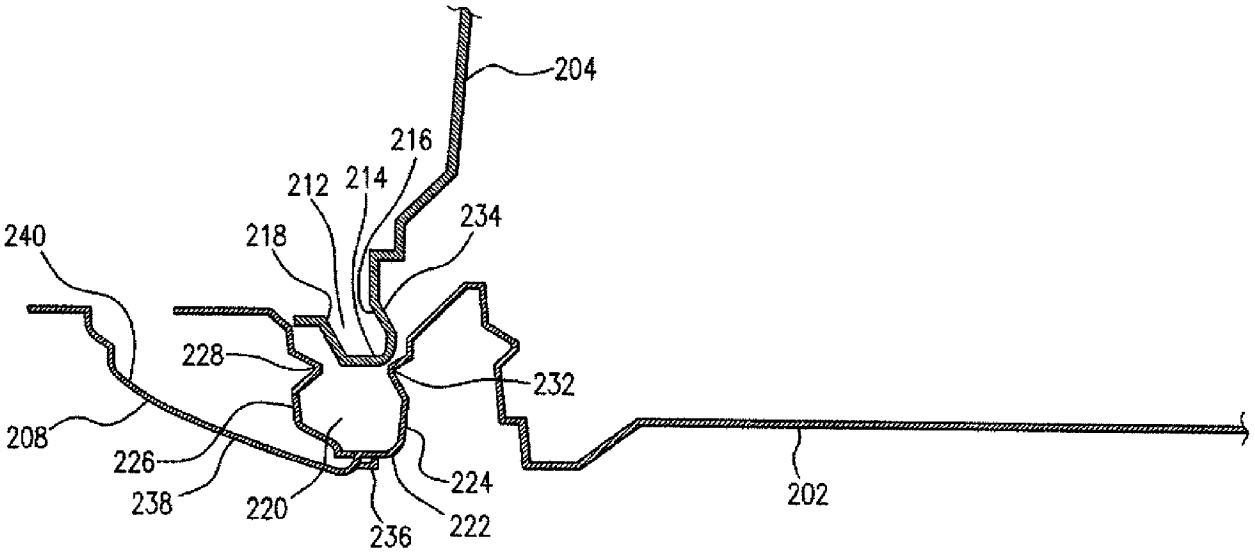

FIGS. 12A-12C schematically and sequentially illustrate the operation of the exemplary closure and release mechanism of the embodiment of FIGS. 7-11D according to the disclosed subject matter. To illustrate the cooperation of the lever projection 208 portions of the base rim 206 with the lock projection 228 and inner lock projection 232 portions of the base rim 206, FIGS. 12A-12C each shows a cross-section of the lock projection 228 portion (for example, as in FIG. 11B) overlaid onto a cross-section of the lever projection 208 and inner lock projection 232 portion (for example, as in FIG. 11D).

FIG. 12A shows the lid 204 initially in a closed position, with the lid channel 212 disposed within the channel space of the base channel 220, the lock projection 228 disposed above the outer sidewall 218 of the lid channel 212, the inner lock projection 232 disposed within the recess 234, and the lever projection 208 extending radially outwardly from the base rim 206, as described herein above.

FIG. 12B shows the configuration of FIG. 12A with a downward force applied to the lever projection 208. The original position of the base rim 210 of FIG. 12A is shown in phantom. The downward force applied to the lever projection 208 pivots the lever projection 208 and base channel 220 about a pivot axis disposed generally within the base channel 220, proximate inner lock projection 232. The pivot axis can be an area of deflection of the inner sidewall 224 of the base channel 220. Additionally or alternatively, a pleat 236 or similar formation can be provided in the base channel 220 to define the pivot axis or hinge for the lever projection 208, as described herein above. The pivotal movement of the lever projection 208 and base channel 220 causes the lock projection 228 to rotate radially outward and away from engagement with the lid rim 210. Additionally, the inner lock projection 232 pivots outwardly away from the lid channel 212 allowing an opening of the base channel 220 to enlarge. The lock projection 228 and inner lock projection 232 can compress the lid channel 212 and urge the lid channel 212 upward and out of the channel space of the base channel 220. As embodied herein, the lid will "pop" out of the base for ease of removal as described below.

FIG. 12C shows the lid 204 in an open position, disengaged from the base 202. Once in the open position, the external force can be removed from the lever projection 208, allowing the lever projection 208 and base channel 220 to rotate back to their original positions. With the lid 204 disposed in the open position, the lock projection 228 and inner lock projection 232 move underneath the bottom wall 214 of the lid channel 212 to support the lid 204 in the open position.

With the lid 204 in the open position, a user can then remove the lid 204 entirely from the base 202 by lifting the lid 204 straight up relative to the base 202 until the lid 204 is moved up beyond the height of a product resting on the base 202, as described above with respect to the embodiment of FIGS. 1-6C. If the base 202 has a plurality of lock projections 228 and inner lock projections 232 engaging the lid rim 210, and a corresponding plurality of lever projections 208 to release the lock projections 228 and inner lock projections 232, each of the lever projections 208 can be operated independently and/or simultaneously as described above to disengage each of the lock projections 228 and inner lock projections 232, and thus disengage the lid 204 from the base 202. For example, by configuring the lever projections 208 to be operated independently, a user can disengage the lid 204 from the base 202 using only one hand.

To restore the lid 204 to the closed position, with the lid 204 in the open position shown in FIG. 12C, a user can apply a downward force to the lid 204. The downward force applied to the lid 204 can urge the lid channel 212 down beyond the lock projection 228 and inner lock projection 232 and into the channel space of the base channel 220, and thus engage the lock projection 228 and inner lock projection 232 with the lid channel 212. The base rim 206 can be provided with an angled or beveled surface proximate an upper edge of the base channel 220 to resist urging the lid rim 210 into the channel space of the base channel 220 in this reclosing step.

Additionally, as shown for example in FIG. 11A, the container 200 can include features to allow for stacking of a container 200 of a similar configuration. For example, the base can have a base bottom surface defining a base stacking feature 244. The base stacking feature 244 can be shaped to align with and receive a lid stacking feature 246 formed in the lid 204 of a similarly shaped container.

While the disclosed subject matter is described herein in terms of certain preferred embodiments, those skilled in the art will recognize that various modifications and improvements may be made to the disclosed subject matter without departing from the scope thereof. Moreover, although individual features of one embodiment of the disclosed subject matter may be discussed herein or shown in the drawings of the one embodiment and not in other embodiments, it should be apparent that individual features of one embodiment may be combined with one or more features of another embodiment or features from a plurality of embodiments. For example, an as described above, the pleat 236 as depicted in FIGS. 9A-9B can be incorporated into the base channel 120 of the embodiment of FIGS. 1-6C.

In addition to the specific embodiments claimed below, the disclosed subject matter is also directed to other embodiments having any other possible combination of the dependent features claimed below and those disclosed above. As such, the particular features presented in the dependent claims and disclosed above can be combined with each other in other manners within the scope of the disclosed subject matter such that the disclosed subject matter should be recognized as also specifically directed to other embodiments having any other possible combinations. For example and without limitation, a container according to the disclosed subject matter can have any suitable shape, and can have any suitable number of lever projections and lock projections configured with any of the closure and release mechanism configurations described herein. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the method and system of the disclosed subject matter without departing from the spirit or scope of the disclosed subject matter. Thus, it is intended that the disclosed subject matter include modifications and variations that are within the scope of the appended claims and their equivalents.

We claim:

1. A container comprising:

a base having a base rim forming a base channel including a bottom wall, an inner sidewall, and an outer sidewall to define a channel space, a lock projection extending into the channel space from a first portion of the base rim, and a lever projection extending from a second portion of the base rim, a top surface of the lever projection defining a recess proximate the base channel; and a lid having a lid rim forming a lid channel including a bottom wall, an inner sidewall, and an outer sidewall, the lid having a closed position in which the lid channel is aligned with and disposed at least partially within the channel space of the base channel and the lock projection disposed to resist lifting of the lid channel out of the base channel, and the lever projection configured to pivot about a hinge formed in the bottom wall of the base channel upon application of an external force to the lever projection.

2. The container of claim 1, wherein the lock projection is disposed above the lid channel outer sidewall in the closed position.

3. The container of claim 1, wherein the lid channel outer sidewall defines a notch to receive the lock projection in the closed position.

4. The container of claim 1, wherein the lock projection is disposed on the base channel outer sidewall, the base channel inner sidewall having an inner lock projection disposed opposite the outer sidewall lock projection and extending into the channel space to further resist lifting of the lid channel out of the base channel in the closed position.

5. The container of claim 4, wherein the lid channel inner sidewall defines a notch to receive the inner lock projection in the closed position.

6. The container of claim 4, wherein the inner lock projection is configured to move out from the channel space when the lever projection is pivoted.

7. The container of claim 1, wherein the lock projection is formed by an undercut in the base rim.

8. The container of claim 1, wherein the lock projection is disposed beneath at least a portion of the lid rim when in an open position to support the at least a portion of the lid rim.

9. The container of claim 1, wherein the lock projection is disposed proximate the lever projection.

10. The container of claim 1, wherein the lever projection is disposed at a corner of the base rim.

11. The container of claim 1, wherein a plurality of ribs are disposed on the base channel bottom wall.

12. The container of claim 11, wherein the plurality of ribs extend along the inner sidewall and the outer sidewall of the base channel.

13. The container of claim 1, wherein the base has a base bottom surface defining a base stacking feature, the base stacking feature being shaped to align with a lid stacking feature of a similarly shaped container.

14. The container of claim 1, wherein the lid and the base are formed of sheet plastic.

15. The container of claim 1, wherein the lever projection is configured to cause the lock projection to move out from the channel space and to urge at least a portion of the lid rim out of the base channel upon application of the external force to pivot the lever projection about the hinge.

16. A container comprising:

a base having a base rim forming a base channel including a bottom wall, an inner sidewall, and an outer sidewall to define a channel space, a lock projection extending into the channel space from a first portion of the base rim, and a lever projection extending from a second portion of the base rim; and a lid having a lid rim forming a lid channel including a bottom wall, an inner sidewall, and an outer sidewall, the lid having a closed position in which the lid channel is aligned with and disposed at least partially within the channel space of the base channel and the lock projection disposed to resist lifting of the lid channel out of the base channel, wherein the lever projection has a bottom surface to define a fulcrum proximate the bottom wall of the base channel about which the lever projection is configured to pivot upon application of an external force to the lever projection.

17. The container of claim 16, wherein the bottom surface is arcuate.

18. The container of claim 16, wherein the lever projection is configured to cause the lock projection to move out from the channel space and to urge at least a portion of the lid rim out of the base channel upon application of the external force to pivot the lever projection about the fulcrum.

19. The container of claim 16, wherein the lock projection is disposed on the base channel outer sidewall, the base channel inner sidewall having an inner lock projection disposed opposite the outer sidewall lock projection and extending into the channel space to further resist lifting of the lid channel out of the base channel in the closed position.

20. A container comprising:

a base having a base rim forming a base channel including a bottom wall, an inner sidewall, and an outer sidewall to define a channel space, a lever projection extending from a second portion of the base rim, a lock projection extending into the channel space from a first portion of the base rim, the lock projection including a pair of lock projection parts, each of the pair of lock projection parts being formed on an opposite side of the lever projection and proximate the lever projection; and a lid having a lid rim forming a lid channel including a bottom wall, an inner sidewall, and an outer sidewall, the lid having a closed position in which the lid channel is aligned with and disposed at least partially within the channel space of the base channel and the lock projection disposed to resist lifting of the lid channel out of the base channel, and the lever projection configured to pivot about a hinge formed in the bottom wall of the base channel upon application of an external force to the lever projection.

21. The container of claim 20, wherein the lock projection is disposed on the base channel outer sidewall, the base channel inner sidewall having an inner lock projection disposed opposite the outer sidewall lock projection and extending into the channel space.

22. The container of claim 21, wherein the inner lock projection is configured to move out from the channel space when the lever projection is pivoted.

23. The container of claim 20, wherein the lid rim has a lid flange extending outwardly from the lid channel, and the lock projection is disposed above the lid flange in the closed position.

* * * * *